United States Patent [19]

Goebel

[11] 4,264,031

[45] Apr. 28, 1981

[54] FOLDING, SELF-LOCKING CARTON WITH SEPARATE LID INCLUDING INTEGRAL HANDLE

[75] Inventor: Henry R. Goebel, Camarillo, Calif.

[73] Assignee: Western Kraft Paper Group Willamette Industries, Inc., Camarillo, Calif.

[21] Appl. No.: 112,627

[22] Filed: Jan. 16, 1980

[51] Int. Cl.[3] ..... B65D 25/22; B65D 5/46

[52] U.S. Cl. ..... 229/52 B; 229/45 R; 229/43; 229/41 C; 229/25

[58] Field of Search ..... 229/41 C, 52 B, 52 A, 229/43, 26, 25, 45

[56] References Cited

U.S. PATENT DOCUMENTS

| | | | |
|---|---|---|---|
| 1,946,554 | 2/1934 | Sutherland | 229/43 X |
| 2,120,871 | 6/1938 | Rudowitz | 229/41 C X |
| 2,288,457 | 6/1942 | Inman | 229/52 A X |
| 2,421,453 | 6/1947 | Crawshaw | 229/41 B |
| 3,101,167 | 8/1963 | Styler | 229/41 C |
| 3,581,974 | 6/1971 | Freeman | 229/52 B X |
| 3,809,310 | 5/1974 | VanderLugt | 229/26 |
| 4,003,515 | 1/1977 | Steele | 229/52 B |
| 4,065,047 | 12/1977 | Swan | 229/41 C |
| 4,134,531 | 1/1979 | Martinez et al. | 229/41 C |
| 4,166,568 | 9/1979 | Swan . | |
| 4,227,640 | 10/1980 | Roccafortb | 229/41 C |

*Primary Examiner*—Davis T. Moorhead
*Attorney, Agent, or Firm*—Eugene D. Farley

[57] ABSTRACT

A folding carton having a bucket-like shape. The bottom of the carton body includes a locking flap which is operable to hold the bottom flat. Around the top of the carton is a plurality of holes. A separate lid includes tabs which are engageable in the holes. The lid further includes an integral handle by which the carton may be carried.

16 Claims, 6 Drawing Figures

FOLDING, SELF-LOCKING CARTON WITH SEPARATE LID INCLUDING INTEGRAL HANDLE

BACKGROUND OF THE INVENTION

This invention relates to folding cartons, and more particularly to a folding carton having a bucket-like shape, a locking bottom, and a separate lid including an integral handle.

In the fast food industry, minimizing the cost of containers for take-home or carry-out foods is becoming increasingly important. In the particular case of precooked fried chicken, for example, the container should be strong and easily carryable, and at the same time it is desirable that it be collapsible for shipment and storage prior to use.

The prior art discloses many cartons of a hexagonal or multisided bucket-like shape. However, when a substantial weight is placed in the prior art containers, many of them have a tendency to gap open at the bottom. On the other hand, without weight in the container, as is the case just prior to filling, the bottom has a tendency to buckle, thus making filling the container difficult.

Most prior art containers, which are acceptable for the above-mentioned purpose, do not have a handle for carrying and must be carried in the arms, a relative inconvenience.

Accordingly, it is the object of the present invention to provide a bucket-shaped folding carton having a carrying handle.

Another object is to provide a carton having a separate lid.

A further object is to provide a carton having a locking bottom.

A still further object is to provide a locking bottom cover which seals gaps in the container bottom.

Other objects of this invention will be made apparent in the following specification and claims.

BRIEF SUMMARY OF THE INVENTION

The present invention is a bucket-shaped folding carton having holes around its top rim and a separate lid engageable in the holes. The lid includes panels substantially covering the open top and a central upstanding rib forming a handle. The carton body includes a locking flap engageable to hold the bottom of the carton in position.

BRIEF DESCRIPTION OF THE DRAWINGS

In the drawings, areas having adhesive applied thereon are indicated by stippled shading. A dot-dash line indicates a hinge line formed by scoring or creasing the material.

DESCRIPTION OF THE PREFERRED EMBODIMENT

Figure 2:
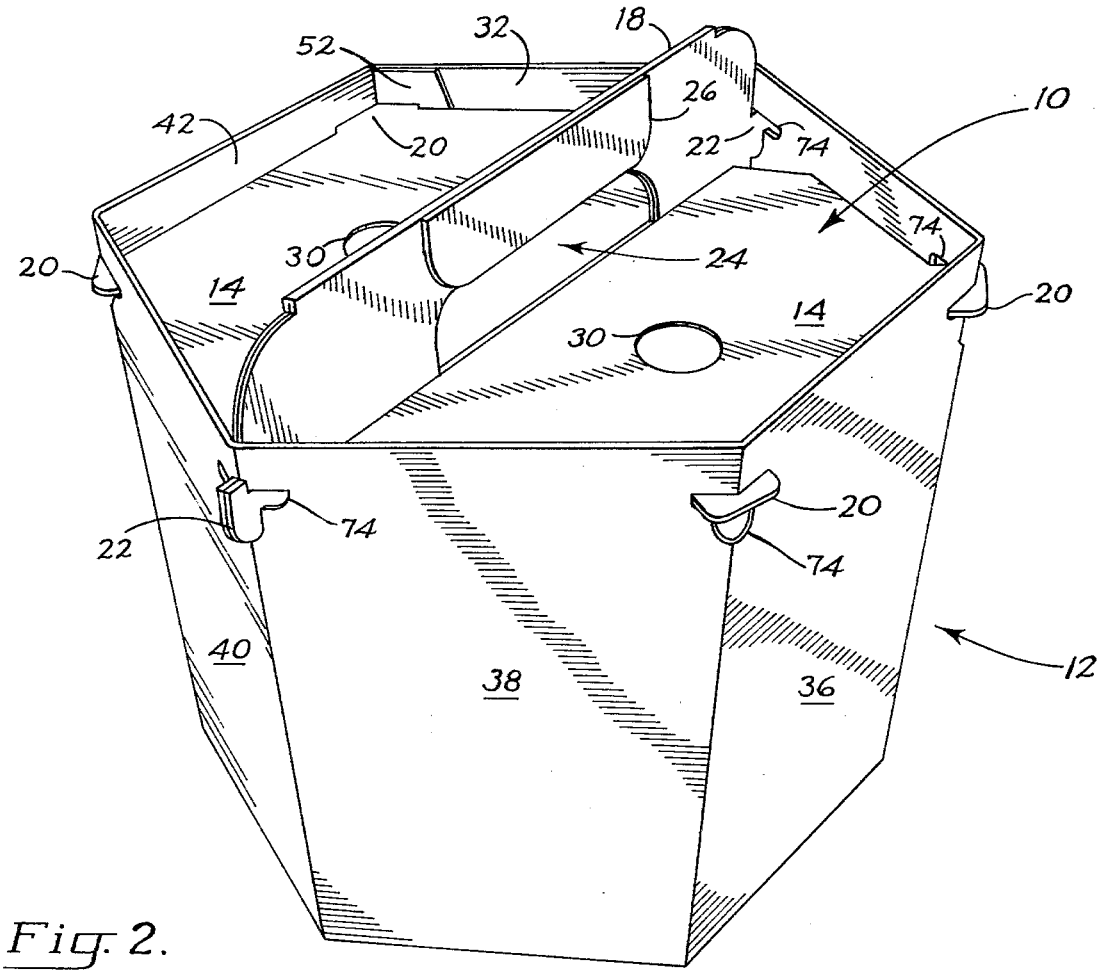
FIG. 2 is a top perspective view of the carton showing the lid engaged.

Referring to FIG. 2, lid 10 is shown generally, engaged with carton body 12. Preferably the lid and carton body are hexagonal, however, the carton body may be square or polygonal, and the periphery of the lid may be square, polygonal or substantially round.

Figure 1:
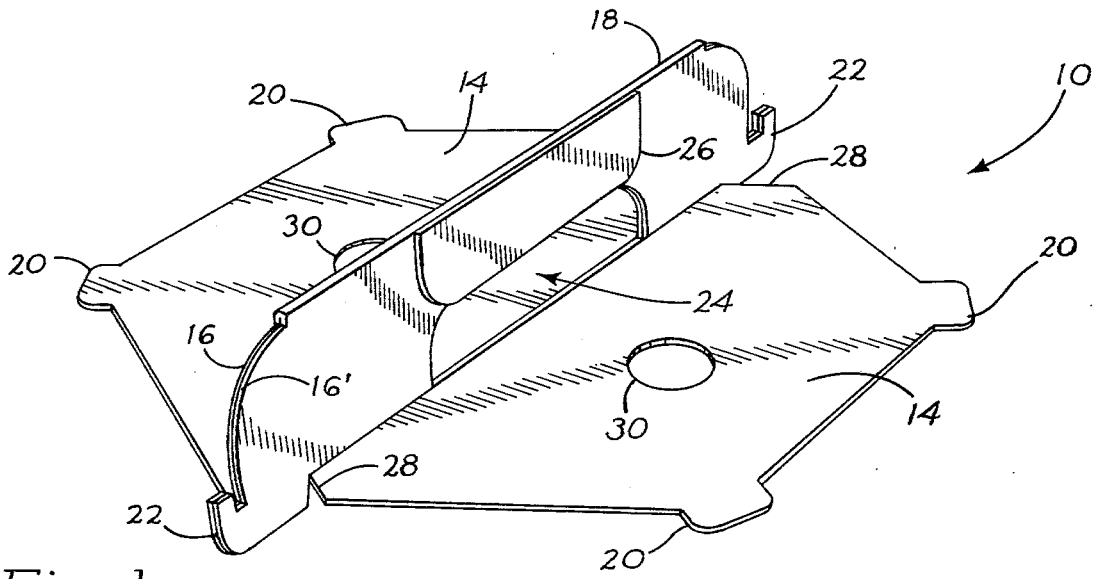
FIG. 1 is a top perspective view of the lid.

FIG. 1 shows the lid comprised of cover panels 14 and handle panels 16 and 16' which are hinged together and hinged to the cover panels to upstand therefrom forming a central rib 18. Tabs 20 extend from the periphery of the cover panels. Extensions, preferably in the form of hooks 22 are formed integrally with the central rib and extend outwardly from both ends thereof, preferably below the plane of the cover panels, to engage with the carton body.

A hand hole 24 is formed through the central rib 18, and a hand hole flap 26 is hinged to the upper edge of handle panel 16. It is rotatable 180° through the hand hole to serve as a finger guard when carrying the carton.

Figures 3, 4:
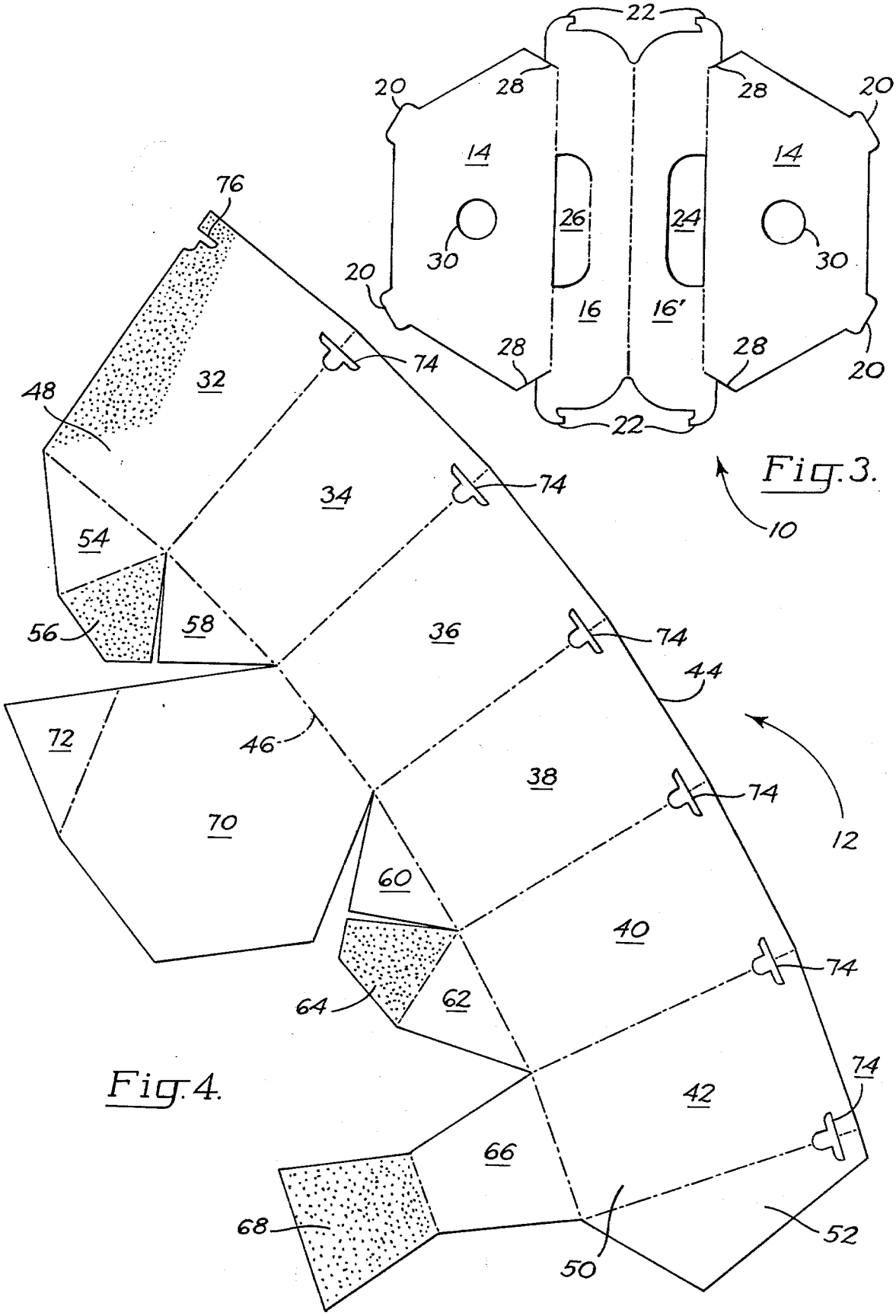
FIG. 3 is a top view of the lid in its unfolded or blank form.
FIG. 4 is a top plan view of the carton body in its unfolded or blank form.

Now referring to FIG. 3, the lid is shown in its unfolded or blank condition. It is preferably die cut out of medium thickness paperboard and either or both sides may be coated or printed on as desired. The hinge lines are scored to allow the two handle panels 16 and 16' to form the central rib 18, and to allow the hand hole flap 26 to be rotatable through the handhole 24. An inward cut 28 at the ends of each handle flap allow the extensions of the central rib to be positioned below the plane of the cover panels 14. The cover panels include ventilation holes 30.

The carton body is shown in FIG. 4 in its unfolded condition. The blank is die-cut, similarly to the lid, from medium thickness paperboard and may be coated or printed as desired.

A plurality of articulate side panels 32, 34, 36, 38, 40 and 42 forming the sides of the carton are each shaped similarly with a trapezoidal configuration. As a group they have a top edge 44, a bottom edge 46, and ends 48 and 50. They are jointed at the hinge lines which are formed by creasing or scoring the blank. At one end 50 a glue flap 52 is hinged to side panel 42 and is adhesively attachable to the other end 48 of the side panels. Preferably, the reverse side of the glue flap is attachable to the obverse side of panel 32 forming a tubular body with the glue flap on the interior.

Attached to the bottom edges of selected side panels 32, 34, 38, 40 and 42 are a plurality of bottom support flaps 54, 56, 58, 60, 62, 64, 66 and 68 which are foldable perpendicular to the side panels. Flap 56 is adhesively attachable to the reverse side of flap 58, and likewise flap 64 is attachable to flap 60.

A bottom cover panel 70 is hinged to the bottom edge of one of the side panels 36 and is foldable perpendicular to the side panels to cover the segmented bottom formed by the support flaps. Flap 68 is adhesively attachable to the reverse side of the bottom cover panel adjacent to its hinge line.

Figure 5:
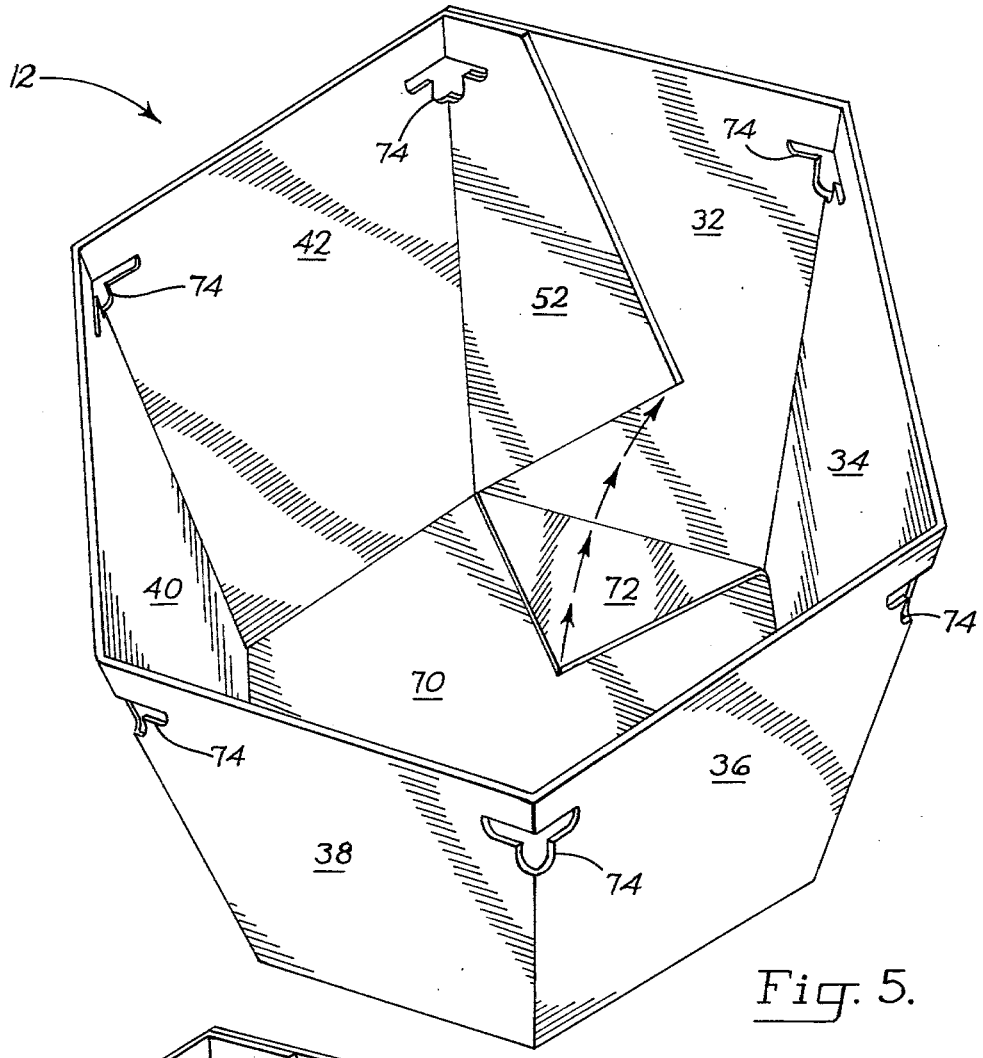
FIG. 5 is a top perspective view of the carton body showing the locking flap in its unlocked position.
Figure 6:
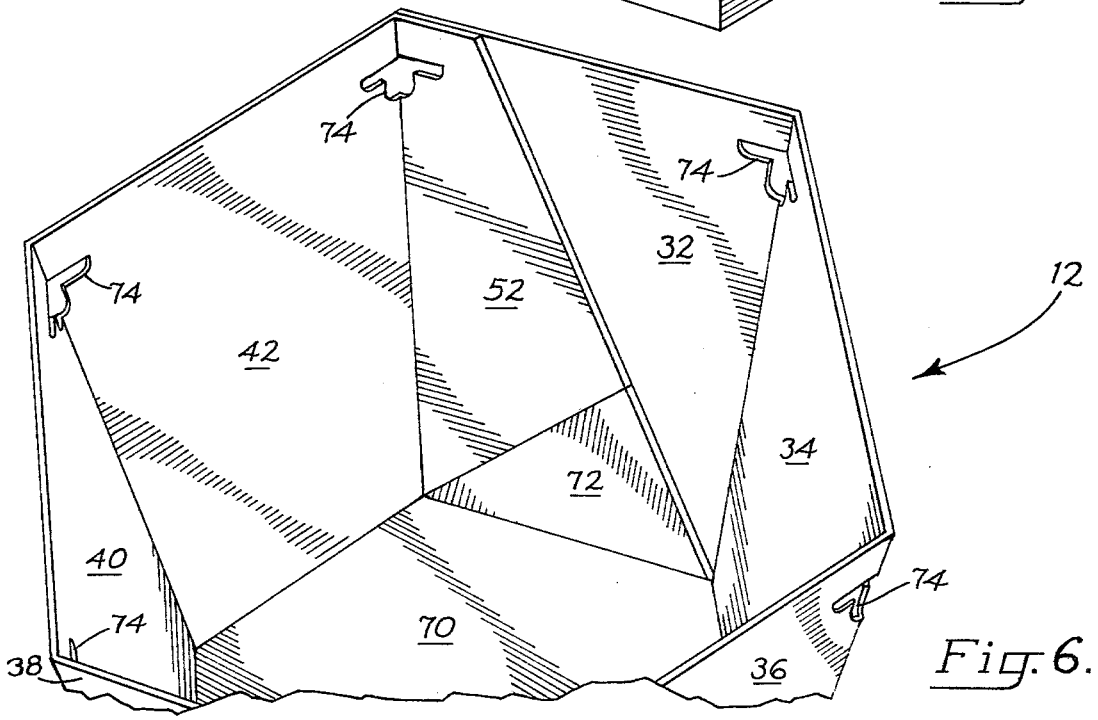
FIG. 6 is a fragmentary top perspective view similar to FIG. 5 showing the locking flap in its locked position.

As shown in FIGS. 4, 5 and 6, a locking flap 72 is hinged to bottom cover panel 70. The locking flap is configured to engage the edge of glue flap 52 in wedging abutment, holding the bottom cover panel in position at the bottom of the carton. Preferably, the glue flap is configured to leave a space between the bottom edge of the glue flap, in the plane thereof, and the bottom of the carton, and the locking flap is configured to fill that space, its top edge abutting the bottom edge of the glue flap.

Adjacent to the top edge 44 of the carton body, the side panels include a plurality of holes 74. Preferably the holes are located on the hinge lines which are the angles of the carton. The shape of the holes is preferably that of a "T" with a distended stem.

Tabs 20 on the lid are engageable with the upper part of the holes (FIG. 2) and the hooks 22 are engageable with the stem part of the holes.

For ease in determining the orientation of the lid, all of the holes are configured similarly. In addition, added ventilation is provided around the periphery of the top of the carton by holes of the present configuration. At the end 48 of the side panels a half hole shape 76 is provided to match with the hole on the other end 50 when the carton is assembled.

OPERATION

The manner of use of the folding carton of the preferred embodiment can be conveniently described in two phases, namely: pre-assembly normally done at the factory, and the final use by the end user.

In the factory, after the blank for the carton body 12 is die-cut and scored, the adhesive attachments are made. Glue flap 52 is attached to the opposite end panel 32 forming a tubular body with the glue flap on the interior. Bottom cover panel 70 is folded into the tubular body, and bottom support flap 68 is adhesively attached to the section of panel 70 adjacent to its hinge line.

Flap 56 and flap 58 are adhesively attached, and flap 64 and flap 60 are likewise attached. The carton body may now be folded flat, with the bottom cover panel and the support flaps inside the flattened carton.

The end user thus receives the carton in a semi-assembled, flattened condition. When the carton body 12 is rounded, the bottom support flaps 54, 56, 58, 60, 62, 64, 66 and 68 and the bottom cover panel 70 make the bottom of the carton. The locking flap, as seen in FIG. 5 is folded up against side panel 32 to come into wedging abutment with glue flap 52.

In FIG. 6 the edge of the locking flap and the edge of the glue flap are shown engaged. This forces the bottom cover panel flat, and maintains the carton in its rounded or expanded position.

The lid 10 is received by the end user in its unfolded or blank condition. It is folded to assume the shape shown in FIG. 1. The hand hole flap 26 is folded 180° through the hand hole 24.

The carton is then filled with fried chicken or other product and the lid 10 engaged with the carton body 12. Tabs 20 are inserted in the corresponding holes 74, and hooks 22 are engaged in two of the opposing holes 74. The lid may assume any of several orientations on the carton body because of the universal design of the holes.

Having described my invention in its preferred embodiment, I claim:

1. For use with a carton having an open top and a plurality of holes in the rim of the top, an engageable lid comprising:

(a) two cover panels, each configured and dimensioned to cover substantially half of the open top of the carton;

(b) a handle panel hinged to each of the cover panels, the handle panels being hinged together and foldable to form a central rib above the cover panels;

(c) the central rib having a hand hole therein to form an integral handle;

(d) an extension formed integrally with the central rib, on each end thereof, configured to be engageable with two opposite holes in the rim of the top of the carton; and (e) a plurality of tabs extending outwardly from the periphery of the cover panels and insertable in and engageable with the holes in the rim of the carton.

2. The engageable lid of claim 1 wherein the extensions are upward opening hooks.

3. The engageable lid of claim 1 wherein the cover panels have at least one ventilation hole therein.

4. A carton comprising in combination:

(a) a carton body having an open top and a plurality of holes in the rim of the top; and (b) a lid comprising (1) two cover panels, each configured and dimensioned to cover substantially half of the open top of the carton, (2) a handle panel hinged to each of the cover panels, the handle panels being hinged together and foldable to form a central rib above the cover panels, (3) the central rib having a hand hole therein to form an integral handle, (4) an extension formed integrally with the central rib, on each end thereof, configured to be engageable with two opposite holes in the rim of the top of the carton, and (5) a plurality of tabs extending outwardly from the periphery of the cover panels and insertable and engageable with the holes in the rim of the carton.

5. The carton of claim 4 wherein the configuration of the carton body and lid is polygonal.

6. The carton of claim 4 wherein the configuration of the carton body and lid is hexagonal.

7. The carton of claim 4 wherein the extensions are upward opening hooks.

8. The carton of claim 4 wherein the cover panels have at least one ventilation hole therein.

9. The carton of claim 4 wherein the carton body comprises a plurality of hinged panel segments.

10. The carton of claim 4 wherein the holes in the rim of the carton body have a T shaped configuration.

11. A polygonal folding carton having a locking bottom comprising:

(a) a plurality of articulate side panels having two ends, a top edge and a bottom edge;

(b) a glue flap hinged to one end of the side panels, the glue flap underlapping and attachable by adhesion to the other end of the side panels forming a tubular body;

(c) a plurality of bottom support flaps hinged to the bottom edges of selected side panels, the bottom support flaps being adhesively engageable to provide a segmented bottom for the tubular body;

(d) a bottom cover panel hinged to the bottom edge of one of the side panels, configured and dimensioned to substantially cover the segmented bottom; and (e) a locking flap hinged to the bottom cover panel configured to engage the glue flap in wedging abutment, holding the bottom cover panel in position at the bottom of the carton.

12. The folding carton of claim 11 wherein the glue flap is configured to leave a space between the bottom edge of the glue flap, in the plane thereof, and the bottom of the carton, and the locking flap is configured to fill that space, its top edge abutting the bottom edge of the glue flap.

13. The folding carton of claim 11 wherein the configuration thereof is hexagonal.

14. The folding carton of claim 11 wherein the side panels include a plurality of holes adjacent to the top edge thereof.

15. The folding carton of claim 14 wherein the holes are located at the hinges of the panels or the angles of the carton.

16. The folding carton of claim 14 wherein the holes have a T shaped configuration.

* * * * *